US009085898B2

(12) United States Patent
Arnold

(10) Patent No.: US 9,085,898 B2
(45) Date of Patent: Jul. 21, 2015

(54) SYSTEM AND METHOD OF REINFORCING A COLUMN POSITIONED PROXIMATE A BLOCKING STRUCTURE

(71) Applicant: Fyfe Co. LLC, San Diego, CA (US)

(72) Inventor: Scott F. Arnold, Solana Beach, CA (US)

(73) Assignee: Fyfe Co. LLC, San Diego, CA (US)

( * ) Notice: Subject to any disclaimer, the term of this patent is extended or adjusted under 35 U.S.C. 154(b) by 0 days.

(21) Appl. No.: 14/196,613

(22) Filed: Mar. 4, 2014

(65) Prior Publication Data

US 2014/0245695 A1 Sep. 4, 2014

Related U.S. Application Data

(60) Provisional application No. 61/772,488, filed on Mar. 4, 2013.

(51) Int. Cl.
*E04C 5/01* (2006.01)
*E04C 3/34* (2006.01)
*E04G 23/02* (2006.01)

(52) U.S. Cl.
CPC . *E04C 5/012* (2013.01); *E04C 3/34* (2013.01); *E04G 23/0218* (2013.01)

(58) Field of Classification Search
CPC ..... E04C 3/34; E04C 5/012; E04C 23/0218
USPC ..... 52/156, 649.1, 649.2, 698, 834, 835, 52/167.1, 514, 514.5, 327, 223.8, 417, 52/600, 741.3
See application file for complete search history.

(56) References Cited

U.S. PATENT DOCUMENTS 4,040,220 A * 8/1977 Henager ..... 52/259
4,333,285 A * 6/1982 Koizumi et al. ..... 52/252
5,218,810 A 6/1993 Isley, Jr.
(Continued)

FOREIGN PATENT DOCUMENTS

EP 0837202 A1 4/1998
EP 1016767 A1 7/2000
(Continued)

OTHER PUBLICATIONS

International Search Report in related PCT Application PCT/US2014/020364 dated Apr. 6, 2014 , 4 pages.
(Continued)

*Primary Examiner* — Rodney Mintz
(74) *Attorney, Agent, or Firm* — Senniger Powers LLP

(57) ABSTRACT

A method of reinforcing a column positioned proximate a blocking structure that prevents wrapping a sheet material completely about the column. The column includes an exterior perimeter surface portion extending between first and second intersections with the blocking structure so that the exterior perimeter surface portion is accessible from one side of the blocking structure. A first opening is formed in the column and/or the blocking structure. The first opening is located proximate the first intersection of the exterior perimeter surface portion of the column and the blocking structure. A portion of the first fiber anchor is inserted through the first opening. The first fiber anchor has at least a first end. The first end of the first fiber anchor is secured to the exterior perimeter surface portion of the column. An outer fibrous sheet is applied to the exterior perimeter surface portion.

22 Claims, 9 Drawing Sheets

(56) References Cited

U.S. PATENT DOCUMENTS

| | | | | |
|---|---|---|---|---|
| 5,567,374 | A * | 10/1996 | Thicthener et al. | 264/137 |
| 5,607,527 | A * | 3/1997 | Isley, Jr. | 156/71 |
| 5,617,685 | A * | 4/1997 | Meier et al. | 52/223.8 |
| 5,649,398 | A | 7/1997 | Isley, Jr. et al. | |
| 5,657,595 | A | 8/1997 | Fyfe et al. | |
| 5,894,003 | A * | 4/1999 | Lockwood | 264/36.19 |
| 5,925,579 | A * | 7/1999 | Neuner et al. | 442/175 |
| 6,330,776 | B1 * | 12/2001 | Jinno et al. | 52/649.1 |
| 6,363,681 | B1 * | 4/2002 | Neuner | 52/834 |
| 6,416,693 | B1 * | 7/2002 | Lockwood | 264/36.19 |
| 6,763,646 | B1 * | 7/2004 | Bonomo | 52/649.6 |
| 6,790,518 | B2 * | 9/2004 | Grace et al. | 428/298.1 |
| 7,207,149 | B2 * | 4/2007 | Fyfe et al. | 52/698 |
| 7,574,840 | B1 | 8/2009 | Fyfe | |
| 8,511,043 | B2 * | 8/2013 | Fyfe | 52/834 |
| 2002/0124930 | A1 * | 9/2002 | Bleibler et al. | 156/71 |
| 2003/0110733 | A1 * | 6/2003 | Grace et al. | 52/724.1 |
| 2004/0016200 | A1 * | 1/2004 | Fyfe | 52/698 |
| 2006/0070338 | A1 * | 4/2006 | Pantelides et al. | 52/721.3 |
| 2009/0211194 | A1 * | 8/2009 | Fyfe et al. | 52/657 |
| 2011/0219710 | A1 | 9/2011 | Fyfe | |
| 2012/0047841 | A1 * | 3/2012 | Fyfe et al. | 52/695 |
| 2013/0232895 | A1 * | 9/2013 | Berset et al. | 52/223.8 |

FOREIGN PATENT DOCUMENTS

| | | | |
|---|---|---|---|
| JP | 972100 | A | 3/1997 |
| JP | 11152931 | A | 6/1999 |
| JP | 2000257274 | A | 9/2000 |
| WO | WO 2014138092 | A1 * | 9/2014 |

OTHER PUBLICATIONS

Written Opinion in related PCT Application PCT/US2014/020364 dated Apr. 6, 2014 , 5 pages.

* cited by examiner

SYSTEM AND METHOD OF REINFORCING A COLUMN POSITIONED PROXIMATE A BLOCKING STRUCTURE

CROSS-REFERENCE TO RELATED APPLICATIONS

This application claims priority to U.S. Provisional Application No. 61/772,488, filed Mar. 4, 2013, the contents of which are incorporated herein by reference in their entirety for all purposes.

BACKGROUND

The present invention generally relates to load bearing structures such as buildings, bridges, etc., and more particularly to a method of reinforcing a column positioned proximate a blocking structure such as a wall or spandrel beam.

Building structures are often made up of reinforced concrete columns. For many years, reinforced concrete columns were internally reinforced with ductile and high tensile strength material, such as steel rebar, primarily along their vertical (longitudinal) axes. Because such structures typically experience loading only in the vertical direction, the reinforcement of structural columns was thought to be exclusively needed along that axis. However, long experience has shown that in the event of an earthquake or a tremor, load bearing structures experience non-normal loading conditions, including particularly lateral loading. Under such non-normal loading conditions, vertically oriented columns are subjected to shearing. If the columns are not properly strengthened to prevent the formation of shear cracks, they may catastrophically fail. Newer structures have concrete columns that are reinforced against lateral (non-normal) loading conditions. However, many older structures remain that do not have reinforcement against non-normal loading.

In response to these risks, structures not originally designed and built to withstand non-normal loading conditions have been retrofitted to improve the shear capacity of their original columns. Many of the known methods of retrofitting reinforced concrete columns are unduly expensive or severely limit the use of the structure while they are being performed. One less expensive method of reinforcing concrete columns to improve their shear capacity and ductility involves confining the column in high strength fiber reinforced polymer. While this method is less time consuming, costly, and disruptive than other known methods, it is important for the best results that the column can be truly confined in the fibrous sheet material, that is, wrapped in fibrous sheets around its entire perimeter.

In many instances, a blocking structure, such as a spandrel beam or a wall attached directly to a column, makes it impossible to wrap sheet material completely about the column. In such instances, the column cannot be as effectively wrapped in fibrous sheets to achieve reinforcement through confinement without separating the column from the blocking structure to access its entire perimeter. The joints between columns and blocking structures are often critical to the structural integrity of load bearing structures. Separating blocking structures from the columns to which they are joined is an expensive proposition. It would require extensive demolition and would be highly disruptive to the ordinary use of the load bearing structure. In some cases, it may not even be possible for the load bearing structure to withstand the required demolition.

SUMMARY

In one aspect, the present invention includes a method of reinforcing a column positioned proximate a blocking structure that prevents wrapping a sheet material completely about the column. The column includes an exterior perimeter surface portion extending between first and second intersections with the blocking structure so that the exterior perimeter surface portion is accessible from one side of the blocking structure. A first opening is formed in at least one of the column and the blocking structure. The first opening is located proximate the first intersection of the exterior perimeter surface portion of the column and the blocking structure. A second opening is formed in at least one of the column and the blocking structure. The second opening is located proximate the second intersection of the exterior perimeter surface portion of the column and the blocking structure. A portion of the first fiber anchor is inserted through the first opening. The first fiber anchor comprises at least a first end. The first end of the first fiber anchor is secured to the exterior perimeter surface portion of the column. An outer fibrous sheet is applied to the exterior perimeter surface portion.

In another aspect of the invention, a load bearing structure comprises a blocking structure. A column has a perimeter surface positioned proximate the blocking structure such that an exterior perimeter surface portion extends between first and second intersections with the blocking structure and an inaccessible surface portion is blocked by the blocking structure. A first opening in at least one of the column and the blocking structure is located proximate the first intersection. A second opening in at least one of the column and the blocking structure is located proximate the second intersection. A first fiber anchor has a first end and a second end. The second end is received in the first opening, and the first end is secured to the exterior perimeter surface portion of the column. An outer fibrous sheet is disposed on the exterior perimeter surface portion of the column.

Other aspects of the present invention will be apparent in view of the following description and claims.

DETAILED DESCRIPTION

Figure 1:
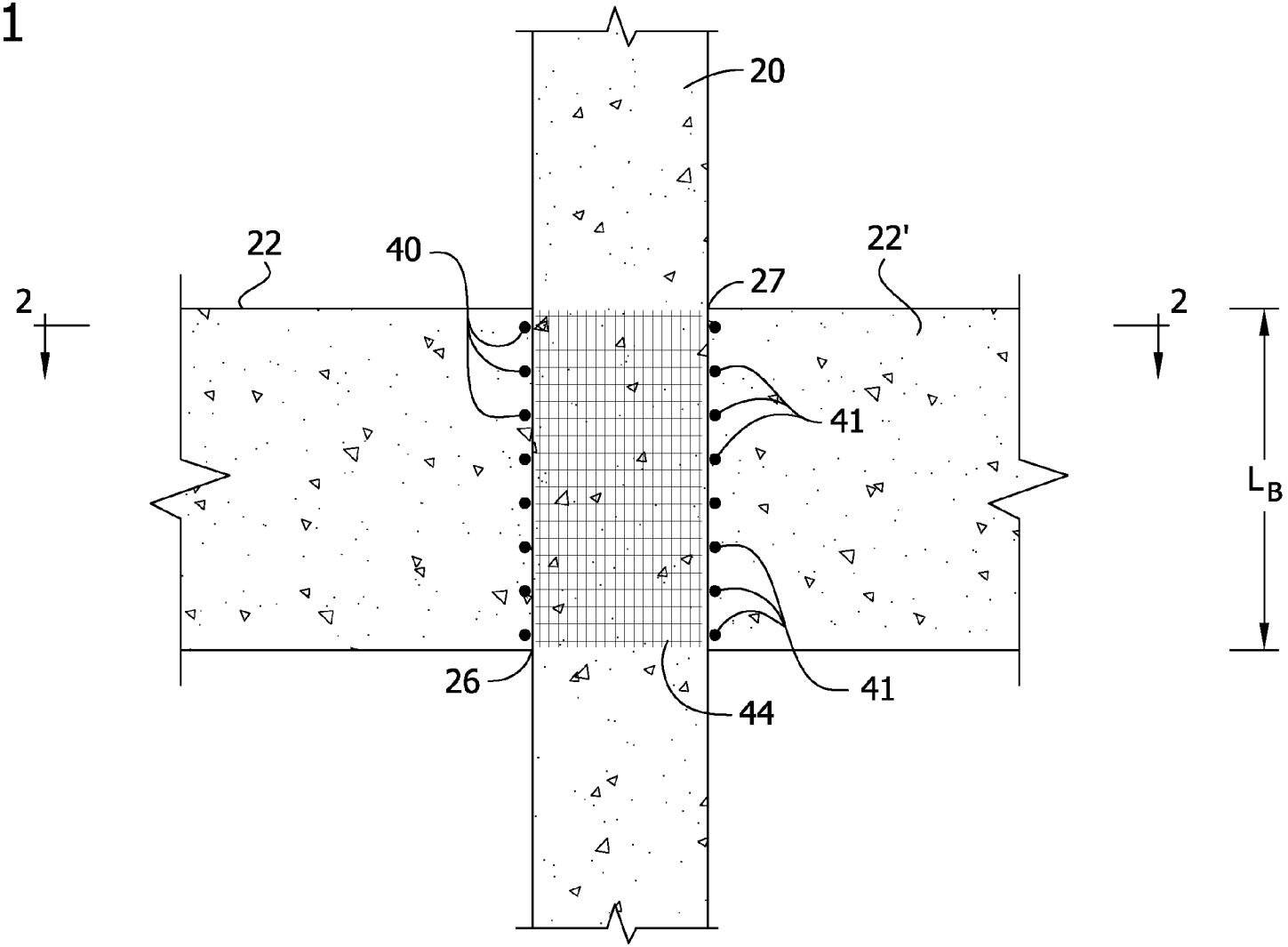
FIG. 1 is a fragmentary elevation of a column joined to a spandrel beam and reinforced according to a first embodiment of the present invention.

Referring to FIGS. 1-4, a column 20 depicted proximate to a blocking structure 22 and reinforced according to a first embodiment of the present invention is shown. Columns 20 in load-bearing structures are often joined to blocking structures 22 such as spandrel beams 22' (FIGS. 1-2), walls 22" (FIGS. 3-4) or other blocking structures which prevent wrapping a sheet of material completely about the column, at least over a certain length of the column LB. When positioned proximate to a blocking structure 22, a column 20 has an exterior perimeter surface 24 that extends between first and second intersections 26, 27 with the blocking structure. This exterior perimeter surface 24 is only accessible from one side of the blocking structure 22. The exterior perimeter surface 24 is the side facing out of the paper in FIGS. 1 and 3. An inaccessible portion 28 of the perimeter of the column 20 is inaccessible because it is blocked by the blocking structure 22.

To reinforce such a column 20 according to the method of the first embodiment of the present invention, first and second holes 30, 31 are to be drilled to form first and second openings 32, 33 proximate the intersections 26, 27 of the exterior perimeter 24 of the column 20 with the blocking structure 22. For purposes of the present description a hole "proximate" the intersection may include a hole drilled at the intersection. The term "drilling" should be read and understood to include any method of boring a hole in a structural element. Thus, drilling may be accomplished with a drill and drill bit or by other methods such as high pressure water boring, etc. Throughout FIGS. 1-7, holes are shown in broken line. As shown best in FIGS. 2 and 4, in one preferred embodiment, the holes 30, 31 are drilled to form first and second openings 32, 33 in the exterior perimeter 24 of the column 20 adjacent each of the intersections 26. However, the holes 30, 31 may also be drilled into the blocking structure 22 at positions adjacent the intersections 26, 27, or the holes could be drilled through the intersections themselves, passing through a portion of each of the column 20 and the blocking structure. In the illustrated embodiment, corresponding pairs of first and second holes 30, 31 are drilled at vertically aligned locations spaced apart along a pair of vertical lines proximate each of the intersections 26, 27. Alternatively, the first hole 30 may be positioned at a location that is vertically offset from its corresponding second hole 31 without departing from the scope of this invention.

Figure 2:
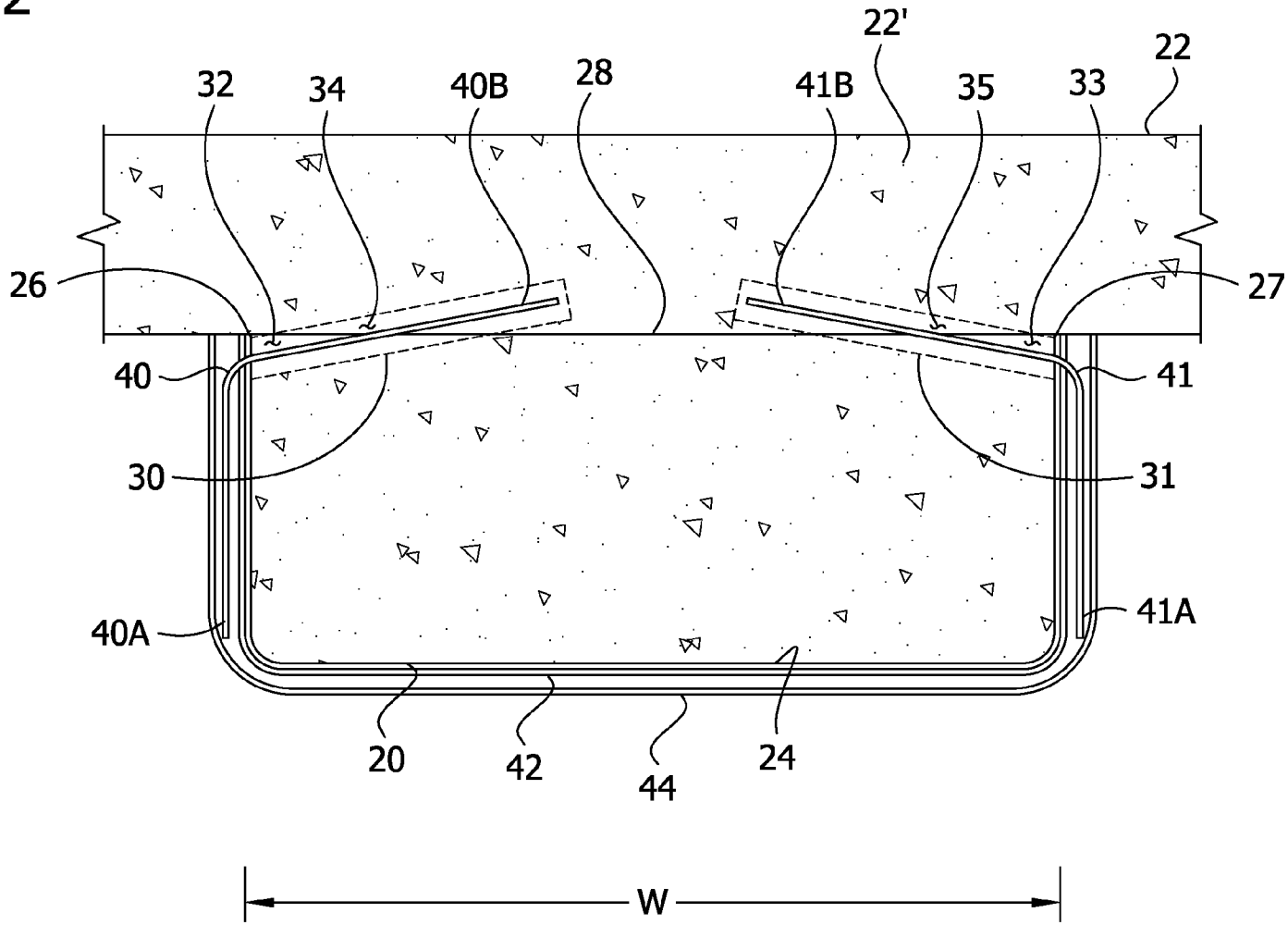
FIG. 2 is a sectional taken along line 2-2 of FIG. 1.
Figure 3:
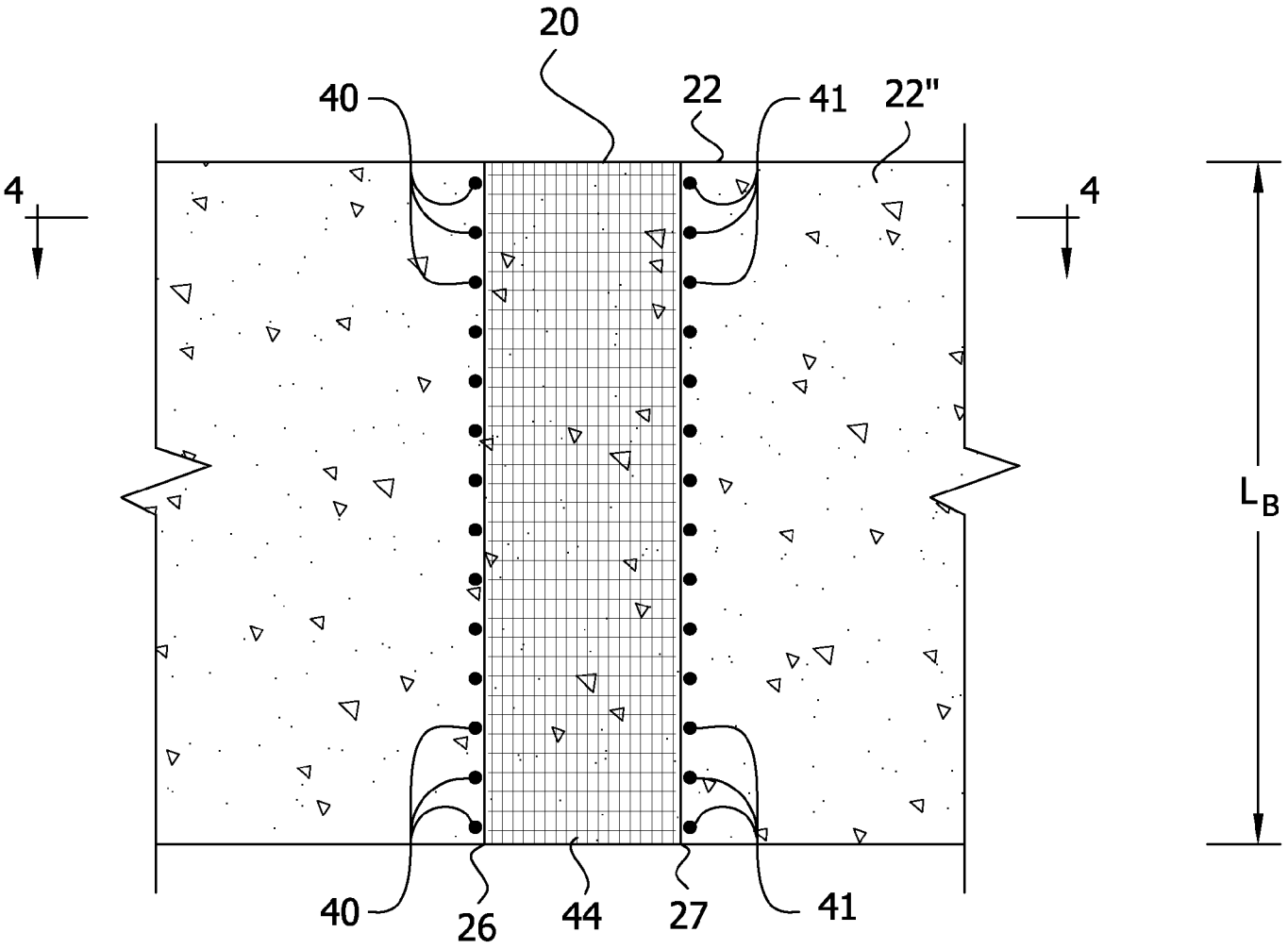
FIG. 3 is a fragmentary elevation of a column joined to a wall structure and reinforced according to the first embodiment of the present invention.
Figure 4:
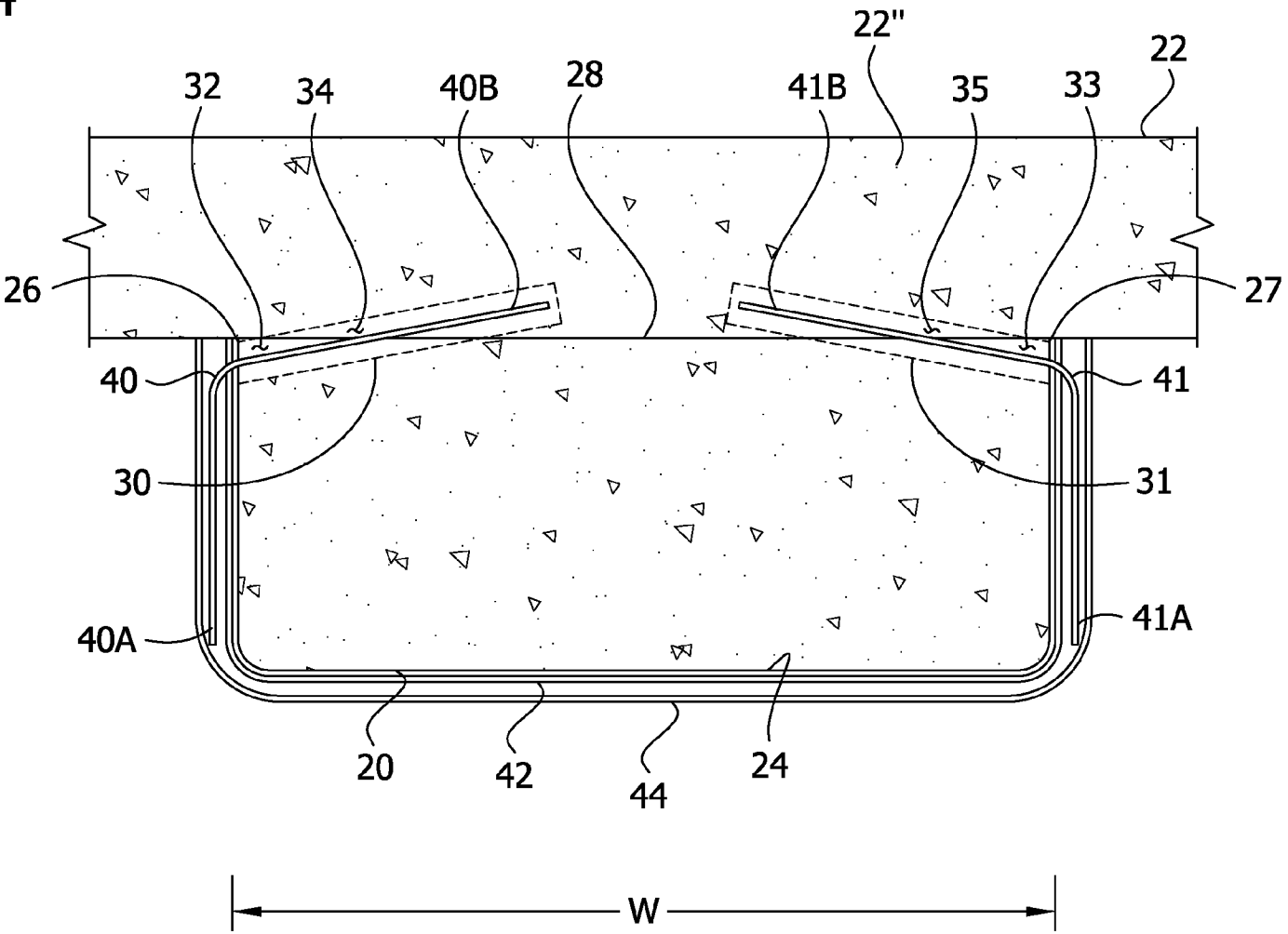
FIG. 4 is a sectional taken along line 4-4 of FIG. 3.

As shown best in FIGS. 2 and 4, the first and second holes 30, 31 are drilled in converging directions. Each first hole 30 is drilled towards its corresponding second hole 31 at an angle. This angle is usually dictated by the drilling device used and the shape of the intersection between the exterior perimeter 24 of the column 20 and the blocking structure 22. However, the angle of each hole 30, 31 with respect to the longitudinal axis of the blocking structure 22 may be in a range of 0° to 90°. In the first embodiment, each angle is preferably in a range of between 0° and 15°. In the illustrated embodiment, the holes 30, 31 are each oriented horizontally, but the holes may be angled vertically without departing from the scope of the invention. In the first embodiment, the holes 30, 31 do not meet one another. Thus, the holes 30, 31 form two separate passageways 34, 35. Each hole 30, 31 has a length and extends into the column 20 a percentage of one-half of the width W of the column. Preferably, each hole 30, 31 extends into the column 20 between 50%-100% of one-half the width W of the column. As may be seen in FIGS. 1 and 3, there are several pairs of first and second holes 30, 31 formed along the height of the column. The holes 30, 31 are located where fiber anchors 40, 41 are shown in FIGS. 1 and 3. Part of the calculations carried out for applying fiber reinforced polymer sheets according to the present invention includes not forming so may pairs of holes 30, 31 as to compromise the strength of the connection between the column 20 and the blocking structure 22 (e.g., wall 22" or spandrel beam 22').

Each of the first and second openings 32, 33 should be sized to receive a respective fiber anchor 40, 41, such as the fiber anchors described in U.S. Pat. No. 7,574,840, the content of which is hereby for all purposes incorporated by reference into this application. Generally, each fiber anchor 40, 41 includes a roving of loosely twisted flexible filaments and has opposite first and second ends 40A, 40B and 41A, 41B. The filaments may be made of glass, graphite, nylon, aramid, carbon, high-modulus polyethylene, ceramic, quartz, PBO, fullerene, LCP, steel, or other material that can be manufactured in long filaments and has high tensile strength. In a preferred embodiment, fiber anchors 40, 41 such as the ¾ inch diameter Tyfo® SCH Composite anchor are used. The holes 30, 31 for each fiber anchor 40, 41 must have a sufficient diameter to receive the ¾ inch roving and the backfill required to bond the anchor to the inner surface of its hole. Throughout the sectional views of FIGS. 1-7, the fiber anchors 40, 41 are depicted as solid bold lines that extend through the broken lines depicting the holes 30, 31. In a preferred embodiment, the holes 30, 31 for receiving ¾ inch anchors 40, 41 have a diameter of 1 inch. Thus, a space is shown between each fiber anchor 40, 41 and the respective hole 30, 31 into which it extends.

Once the appropriate holes 30, 31 are drilled adjacent the intersections 26, 27, at least a first fiber anchor 40 should be installed in at least a first opening 32. As will be discussed in more detail below, each corresponding pair of first and second openings may only require a single fiber anchor in alternative embodiments, but in the separate-passageway arrangement of the first embodiment a first and a second fiber anchor 40, 41 should be installed in the first and second holes 30, 31 respectively. In one preferential embodiment, installing a fiber anchor 40 in an opening 32 includes inserting the second end 40B of the first anchor 40 into the first hole 30. Typically, it is not necessary to use any backfill material in the hole 30, 31 because the anchor 40, 41 is pre-saturated in resin and expands to fill the hole. However, backfill material may be used within the scope of the present invention. Preferably, the second end 40B, 41B of each fiber anchor 40, 41 should extend substantially all the way through the length of its respective hole 30, 31. A small gap (approximately ¼ inch) may be left between the tip of the second end 40B, 41B of the anchor 40, 41 and the end of its hole 30, 31 for filling with backfill. Appropriate backfill materials are discussed in U.S. Pat. No. 7,574,840, which was previously incorporated by reference, at column 3, lines 32-43.

The first end 40A, 41A of each fiber anchor 40, 41 should remain outside of the opening 32, 33 once it is installed. Thus, each fiber anchor 40, 41 should have a length that exceeds the length of the passageway 34, 35 into which it is inserted. The length of the fiber anchor 40, 41 that exceeds the length of the passageway 34, 35 may be considered the splayed end length, because that length of fibers may be splayed against the exterior perimeter surface 24 of the column 20 for bonding. In a preferred embodiment, each fiber anchor 40, 41 is at least 10 inches longer than the passageway 34, 35 into which it is inserted. However, the length of the splayed end 40A, 41A will be calculated based on the bonding area required to provide the desired additional shear capacity and therefore may be other than 10 inches. The first end 40A, 41A of each fiber anchor 40, 41 should be secured to the exterior perimeter surface 24 of the column 20. In all of the illustrated embodiments, an inner fibrous sheet 42 is applied (the application of fibrous sheets will be discussed in more detail below) to the exterior perimeter surface portion 24 of the column 20, such that the inner fibrous sheet directly contacts the exterior perimeter surface portion and the first end 40A, 41A of each anchor 40, 41 must be attached directly to the inner fibrous sheet. In other embodiments (not shown), the first end 40A, 41A of each fiber anchor 40, 41 is attached directly to the exterior perimeter surface portion 24 of the column 20. Attaching an end 40A, 41A of a fiber anchor 40, 41 to either the inner fibrous sheet 42 or the exterior perimeter surface portion 24 of the column 20 and thereby securing it the exterior perimeter surface portion of the column preferably includes splaying the fibers against the surface and applying a curable polymer matrix to bond the splayed fibers to the surface. Preferably, the fibers are splayed to a minimum splay width of 10 inches and a minimum splay length of 10 inches. The measurements given herein are exemplary only, and other dimensions may be used within the scope of the present invention. Moreover, securing the anchor 40, 41 to the column 20 and/or fibrous sheets overlaying the column may be accomplished without splaying within the scope of the present invention.

Finally, an outer fibrous sheet 44 is applied to the exterior perimeter surface portion 24 of the column 20. Preferably, the outer fibrous sheet 44 is applied prior to curing of the curable polymer matrix used in securing the splayed first end 40A, 41A so that the first end of each fiber anchor 40, 41 is further bonded to the outer fibrous sheet 44. The inner and outer fibrous sheets 42, 44 may include high strength fibers that are adapted to carry a curable polymer. As discussed briefly above, it is known in the art to use these types of sheets to increase the strength and ductility of structural elements. For clarity, the fibrous sheets 42, 44 are illustrated schematically as solid bold lines in each of the sectional views (FIGS. 2 and 4). Many types of high strength fabrics may be applied without departing from the scope of this invention. Preferred examples of high strength fabrics include glass fibers and carbon fibers. However, other fibrous materials such as graphite, polyaramid, boron, KEVLAR™, silica, quartz, ceramic, polyethylene, and aramid may also be used alone or in combination. The fibrous sheets 42, 44 may be unitary or comprised of multiple layers and are preferably adapted to carry a curable polymer which may comprise any suitable polymer matrix. Examples of suitable polymer matrices, or resins, include but are not limited to polyester, epoxy, vinyl ester, cyanate, and polyamide. Preferably, the fibrous sheets 42, 44 are lightweight, with a density of between 1.3 g/cm3 to 2.6 g/cm3. Sheets 42, 44 having other densities may be employed within the scope of the present invention. Preferably, the high strength fibrous sheets 42, 44 of the present invention have a majority of fibers extending in the same predetermined direction giving the sheet higher strength in that direction. In the illustrated embodiments, the majority of the fibers extend in the horizontal direction, but other fiber orientations may be used without departing from the scope of the invention. The sheets 42, 44 may also have constituent fibers that are different from other fibers in the sheet. It may be that only these special fibers have the preferred orientation. In one preferred embodiment, the sheets 42, 44 are thin so that the profile of the column is not dramatically altered by application of multiple, often overlying sheets. In another preferred embodiment the sheets 42, 44 have a thickness of about 0.08 inches. Preferably, fibrous sheets such as the Tyfo® SCH-41-2X system are used.

Prior to application of either the inner or the outer fibrous sheet 42, 44, the exterior perimeter surface portion 24 of the column 20 may be cleaned to remove dirt and loose matter from the surface. The term "applying" refers to the process of securing the fibrous sheet 42, 44 to the exterior perimeter surface portion 24 of the column 20. If applied, the inner fibrous sheet 42 would typically be adhered directly to the exterior perimeter surface portion 24 of the column 20. The outer fibrous sheet 44 may be secured to the exterior perimeter surface portion 24 by being adhered to the inner fibrous sheet 42 with the first end 40A, 41A of each fiber anchor 40, 41 sandwiched therebetween. This adhering process may be accomplished through the use of adhesives sprayed on or otherwise applied to the desired surface or surfaces. However, in a preferred embodiment, the fibrous sheets 42, 44 are pre-impregnated or saturated with a synthetic curable resin, such as epoxy, urethane, or other adhesive polymer. Such a fibrous sheet is tacky enough to adhere to a surface on contact. Once initially adhered to the surface 24, the synthetic resin will cure over a period of time in ambient temperature. The cured resin impregnated fibrous sheets 42, 44 firmly adhere to their underlying surfaces, improving the strength and ductility of the structural elements to which they are adhered.

In the first embodiment of the method of the present invention (FIGS. 1-4) each of the first and second fiber anchors 40, 41 is bonded to the passageway 34, 35 defined by its corresponding hole 30, 31. The first end 40A, 41A of each fiber anchor 40, 41 is also bonded to at least the outer fibrous sheet 44 and the column 20. In the illustrated embodiment, the first end of each fiber anchor 40A, 41A is bonded to the inner fibrous sheet 42 attached to the column 20. The fibrous sheets 42, 44 are bonded to the exterior perimeter surface portion 24 of the column 20, but alone fail to confine the column 20 because a portion of the perimeter of the column is blocked (e.g., the inaccessible portion 28) by the blocking structure 22. However, through the method of the present invention, the fiber anchors 40, 41 are bonded with the fibrous sheets 42, 44 and at least partially surround the blocked portion of the perimeter of the column 28. In combination with the fibrous sheets 42, 44, the fiber anchors 40, 41 act to confine and gird essentially the entire perimeter of the column 20. The confinement is obtained without extensive demolition and achieves quantifiable improvements to the shear strength and flexural strength of the column 20, despite the unavailability of access to its entire perimeter.

Figure 5:
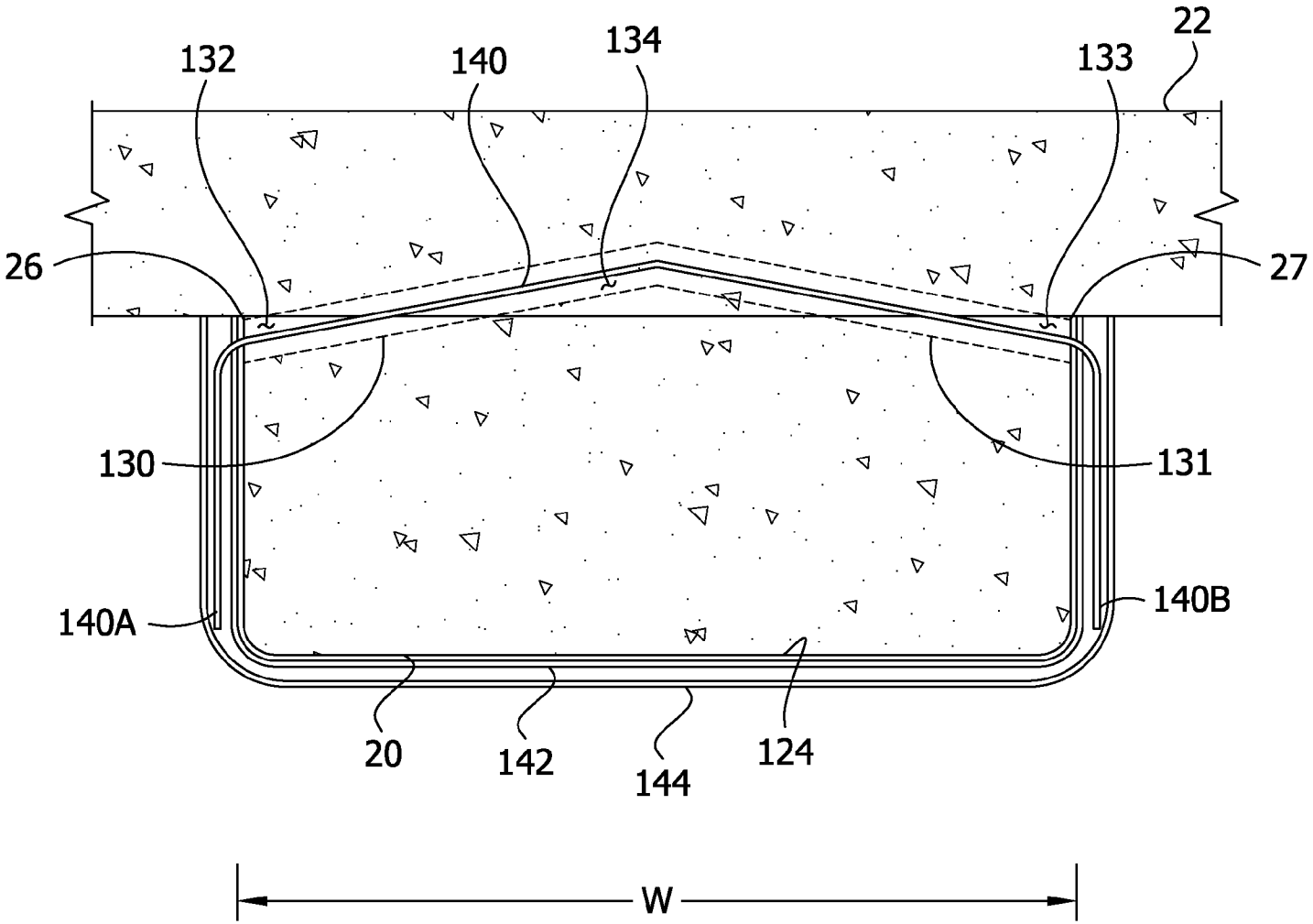
FIG. 5 is a sectional view of a column joined to a blocking structure and reinforced according to a second embodiment of the present invention

FIG. 5 depicts a second embodiment of the method of the present invention that is similar to the first embodiment but varies in ways that will be discussed below. In the second embodiment, the first and second holes 130, 131 form first and second openings 132, 133 that meet to form a single passageway 134 through at least one of the column 20 and blocking structure 22. In the illustrated embodiment, the first and second holes 130, 131 are drilled into the exterior perimeter column surface 24 proximate to the intersections 26, 27 with the blocking structure 22. Preferably the first and second holes 130, 131 are drilled at angles that are equal in magnitude but opposite in direction with respect to the longitudinal axis of the blocking structure 22. Likewise, the first and second holes 130, 131 preferably meet at a depth of approximately one-half the width W of the column. Because the holes 130, 131 of the second embodiment form a single passageway 134 through the column 20 and blocking structure 22, only a single fiber anchor 140 is required. The second end 140B of a fiber anchor 140 should be pushed or pulled through the first hole 130 and pulled or pushed through and out the second hole 131. As with the first embodiment, the first end 140A of the fiber anchor 140 should remain outside of the first hole 130 after the second end has been pulled through. Preferably, the first and second ends 140A, 140B extend past the first and second openings 132, 133 by at least ten inches, but they may extend any length desired to obtain sufficient shear capacity without departing from the scope of the invention. In the illustrated embodiment, an inner fibrous sheet 142 is bonded directly to the exterior perimeter surface 24 of the column 20. Using the methods described above, the first end 140A and the second end 140B are preferably splayed against and bonded to the inner fibrous sheet 142 to secure each end to the exterior perimeter surface portion of the column 24. An outer fibrous sheet 144 is applied to the inner fibrous sheet 142 with each of the first and second fiber anchor ends 140A, 140B sandwiched therebetween. Like the first embodiment, the second embodiment confines the perimeter of the column 20, increasing the column's shear capacity and reducing the likelihood of shear failure.

Figure 6:
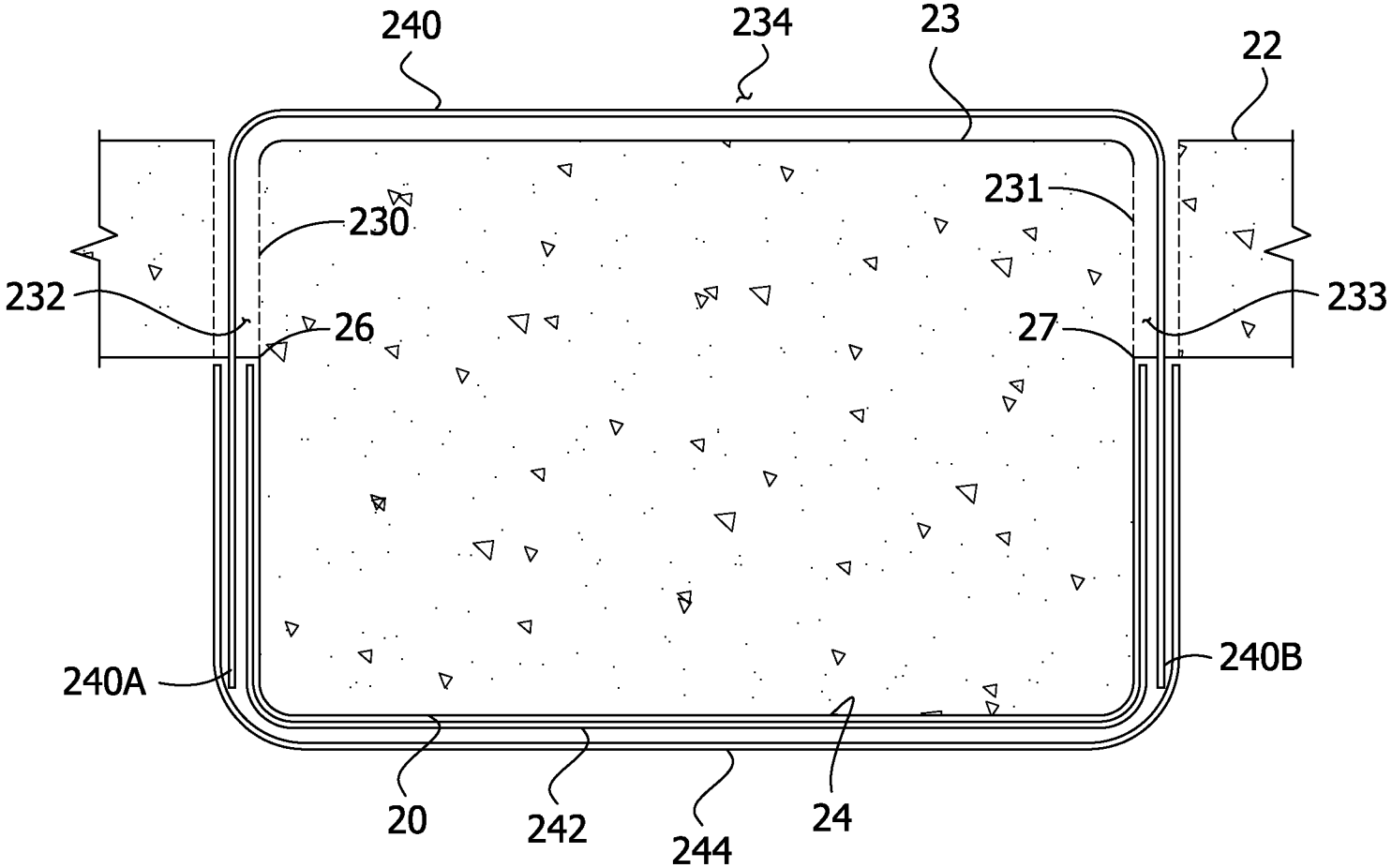
FIG. 6 is a sectional view of a column joined to a blocking structure and reinforced according to a third embodiment of the present invention.

FIG. 6 depicts a third embodiment of the method of the present invention that is similar to the second embodiment in some respects but varies in others which will be discussed below. The first and second holes 230, 231 of the illustrated embodiment form openings 232, 233 that extend entirely through the blocking structure 22 adjacent its intersections 26, 27 with the exterior perimeter surface portion 24 of the column 20. The third embodiment would be particularly well suited for applications in which the blocking structure side opposite the column 23 is accessible. In such cases, the holes 230, 231 can be drilled all the way through the blocking structure 22. Together with the opposite side 23 of the blocking structure 22, the first and second holes 230, 231 form a single passageway 234. As in the second embodiment, the second end 240B of the fiber anchor 240 should be pushed or pulled through the first hole 230, along the opposite side of the blocking structure 23, and pulled or pushed through and out the second hole 231. The first end 240A of the fiber anchor 240 should remain outside of the first hole 230 after the second end 240B has been pulled through. The first and second ends 240A, 240B of the fiber anchor 240 should be secured to the exterior column surface 24 as described in reference to the second embodiment. If possible, the length of the fiber anchor 240 that engages the opposite side of the blocking structure 23 should be attached to the opposite side with epoxy, staples, etc. In the third embodiment, the fiber anchor 240, in combination with the fibrous sheets 242, 244 and the blocking structure 22, confines the entire perimeter of the column 20.

Figure 7:
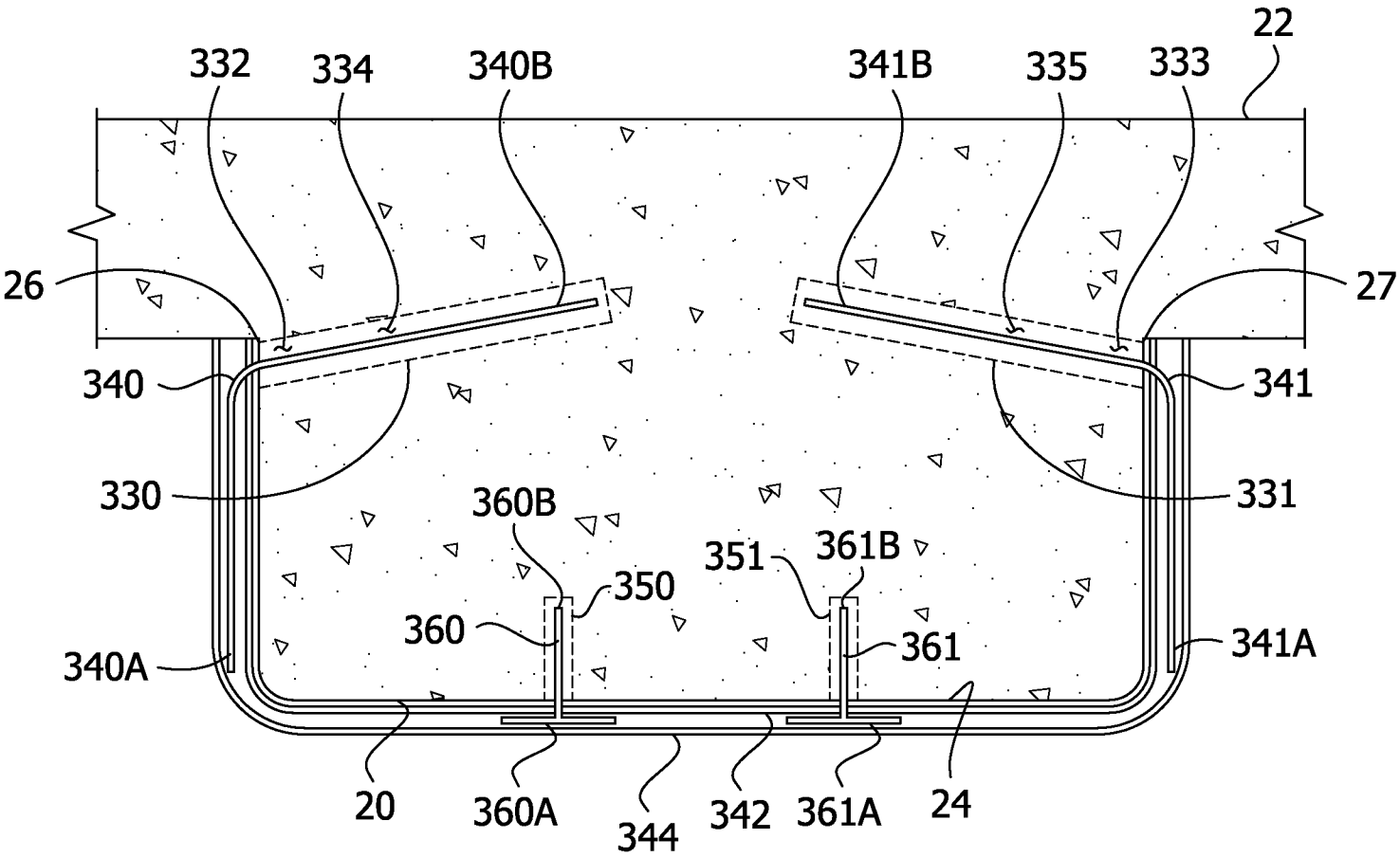
FIG. 7 is a sectional view of a column joined to a blocking structure and reinforced according to a fourth embodiment of the present invention.

FIG. 7 depicts a fourth embodiment of the method of the present invention that is similar to the first embodiment. Like the first embodiment, the first and second holes 330, 331 of the fourth embodiment form separate passageways 334, 335. The first and second fiber anchors 340, 341 and the inner and outer fibrous sheets 342, 344 are applied as described in reference to the first embodiment. However, third and fourth holes 350, 351 are drilled along the exterior perimeter surface portion of the column 24, and third and fourth fiber anchors 360, 361 are installed therein. In the illustrated embodiment, the first end 360A, 361A of each of the third and fourth fiber anchors 360, 361 is splayed against the inner fibrous sheet 342. In other embodiments, the first end 360A, 361A of each additional fiber anchor 360, 361 may be splayed against the outer fibrous sheets 344. Additional fiber anchors such as the third and fourth fiber anchors 360, 361 of the illustrated embodiment are particularly useful in helping secure the fibrous sheets 342, 344 to the column 20. Additional anchors may also be used to secure the fibrous sheets to the column 20 in the second and third embodiments without departing from the scope of the invention. Other fiber anchors and fibrous sheet securement methods may also be used without departing from the scope of the present invention.

Figure 8:
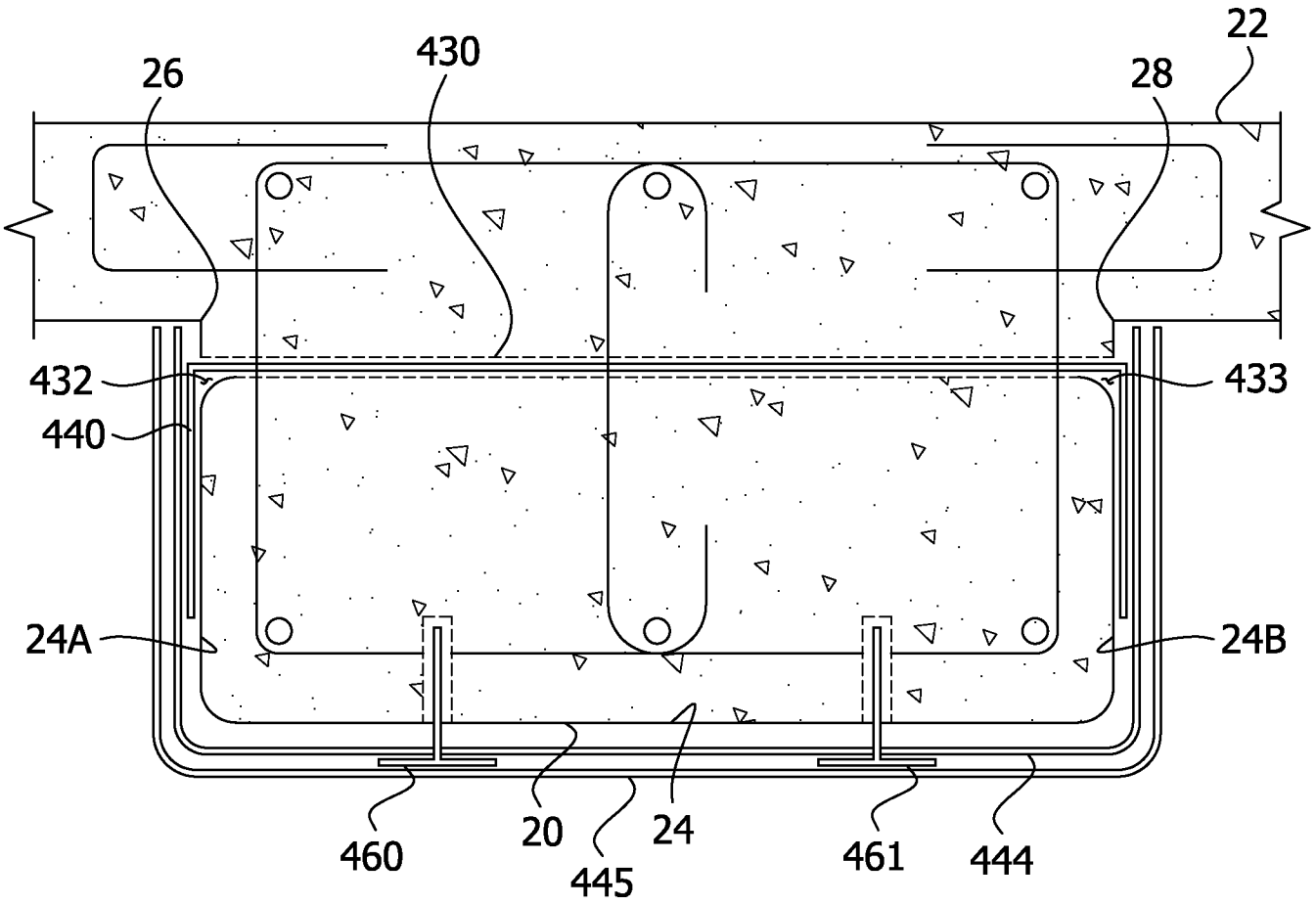
FIG. 8 is a sectional view of a column joined to a blocking structure and reinforced according to a fifth embodiment of the present invention.

FIG. 8 illustrates a fifth embodiment of the method of the present invention that is similar to the fourth embodiment. Unlike the fourth embodiment, a single hole 430 including first and second openings 432, 433 in opposite faces 24A, 24B of the exterior perimeter surface 24 of the column 20 is drilled through the entire width W of the column 20 proximate to the intersections 26, 27 with the blocking structure. A single hole 430 is a suitable alternative to drilling two converging holes (e.g., holes 130, 131 of FIG. 1) that meet at their ends. Preferably, the single hole 430 should be drilled through the column 20 as close as is possible to the blocking structure 22. In a preferential embodiment, the single hole 430 may be oriented parallel to the longitudinal axis of the blocking structure 22. A single first fiber anchor 440 is installed. A first outer fibrous sheet 44 is applied to the exterior perimeter surface portion of the column 24 on top of the first fiber anchor 440. Two additional fiber anchors 460, 461 are installed in holes drilled in the exterior perimeter surface portion of the column 24 to secure the first outer fibrous sheet 44 to the column. A second outer fibrous sheet 445 is applied to the exterior perimeter surface 24 portion of the column 20 on top of the first outer fibrous sheet 444 and the splayed ends of the additional fiber anchors 460, 461.

Figure 9:
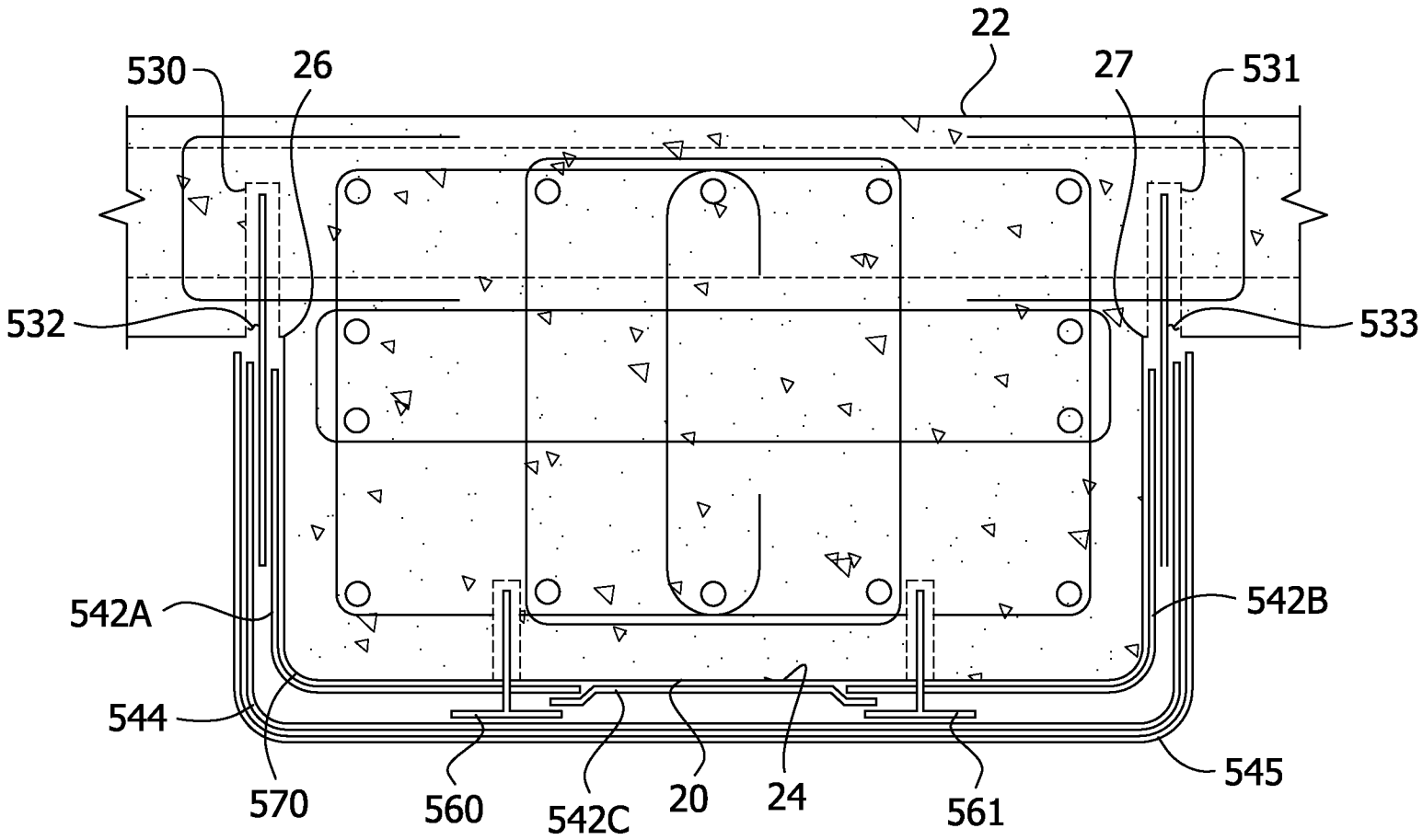
FIG. 9 is a sectional view of a column joined to a blocking structure and reinforced according to a sixth embodiment of the present invention.

FIG. 9 illustrates a sixth embodiment of the method of the present invention. In the sixth embodiment, two holes 530, 531 forming first and second openings 532, 533 are drilled into but not through the blocking structure 22, each proximate to an intersection 26, 27 between the exterior perimeter surface portion of the column 24 and the blocking structure 22. Each of the holes 530, 531 is oriented generally transverse to the longitudinal axis of the blocking structure 22. Preferably, the holes 530, 531 extend at least 5 inches into the blocking structure, though other hole depths may be used without departing from the scope of this invention. For purposes of describing this embodiment, the fibrous sheet 542 is considered to have three sections. A first section 542A extends from a first end proximate a first intersection 26 between the exterior perimeter surface 24 of the column 20 and the blocking structure 22 to a second end past the first additional fiber anchor 560. A second fibrous sheet section 542B extends from a first end proximate a second intersection 27 between the exterior perimeter surface 24 of the column 20 and the blocking structure 22 to a second end past the second additional fiber anchor 561. A third fibrous sheet section 542C extends between the first and second additional fiber anchors 560, 561, preferably overlapping with the second ends of the first and second fibrous sheet sections 542A, 542B by at least one inch. In the illustrated embodiment, first and second outer fibrous sheets 544, 545 are applied to the exterior perimeter surface 24 of the column 20 on top of the splayed ends of the fiber anchors 540, 541, 560, 561 and the first, second, and third sections 542A, 542B, 542C of the inner fibrous sheet 542.

FIGS. 8 and 9 illustrate another optional step in any embodiment of the present invention. When fiber anchors or fibrous sheets are pulled around a corner or a sharp edge, it may be desirable to round the corner or edge. Preferably, each convex corner around which a fiber anchor or fibrous sheet extends should be rounded to a radius of curvature of one inch. In the illustrated embodiment (FIG. 9), the corner 570 is rounded to a 90-degree radius of curvature of at least one inch. Similarly, if the exterior perimeter surface of a column has a profile which requires a fiber anchor or fibrous sheet to be installed on a concave corner, the corner should be filled with epoxy filler to a radius of curvature of approximately one inch, preferably a 90-degree radius of curvature. The radius of curvature is desirable because it prevents stress concentrations from forming on the fiber anchors or fibrous sheets as they are bent or folded at sharp angles.

Having described the invention in detail, it will be apparent that modifications and variations are possible without departing from the scope of the invention defined in the appended claims.

When introducing elements of the present invention or the preferred embodiment(s) thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A load bearing structure comprising:

a blocking structure;

a column having a perimeter surface positioned proximate the blocking structure such that an exterior perimeter surface portion of the column extends between first and second intersections with the blocking structure and an inaccessible surface portion of the column is blocked by the blocking structure, the blocking structure extending substantially an entire height of the column;

a first opening in at least one of the column and the blocking structure, the first opening being located proximate the first intersection;

a second opening in at least one of the column and the blocking structure, the second opening being located proximate the second intersection;

an inner fibrous sheet disposed on the exterior perimeter surface portion of the column;

a first fiber anchor received in the first opening and having a first end secured to the inner fibrous sheet; and an outer fibrous sheet disposed over the inner fibrous sheet;

wherein the first end of the first fiber anchor is sandwiched between the inner fibrous sheet and the outer fibrous sheet.

2. The load bearing structure of claim 1 further comprising a second fiber anchor received in the second opening and having a first end secured to the inner fibrous sheet, wherein the first end of the second fiber anchor is sandwiched between the inner fibrous sheet and the outer fibrous sheet.

3. The load bearing structure of claim 1 wherein the inner fibrous sheet is coextensive with the outer fibrous sheet.

4. The load bearing structure of claim 1 wherein the inner and outer fibrous sheets extend across the exterior perimeter surface portion from adjacent the first intersection to adjacent the second intersection.

5. The load bearing structure of claim 1 wherein the first end of the first fiber anchor includes splayed fibers connecting the first end of the first anchor to the inner fibrous sheet.

6. The load bearing structure of claim 1 further comprising a passageway through at least one of the column and blocking structure connecting the first opening and the second opening.

7. The load bearing structure of claim 6 wherein the first fiber anchor comprises a second end, the second end is secured to the inner fibrous sheet, and the second end is sandwiched between the inner fibrous sheet and the outer fibrous sheet.

8. The load bearing structure of claim 1 further comprising at least a third opening in the exterior perimeter surface portion of the column, and a third anchor received in the third opening.

9. The load bearing structure of claim 8 wherein the third anchor includes a first end having splayed fibers connecting the first end to the inner fibrous sheet.

10. The load bearing structure of claim 9 wherein the first end of the third anchor is sandwiched between the inner fibrous sheet and the outer fibrous sheet.

11. A method of reinforcing a column positioned proximate a blocking structure that prevents wrapping a sheet material completely about the column, the blocking structure extending substantially an entire height of the column, the column including an exterior perimeter surface portion extending between first and second intersections with the blocking structure so that the exterior perimeter surface portion is accessible from one side of the blocking structure, the method comprising:

forming a first opening in at least one of the column and the blocking structure, the first opening being located proximate the first intersection of the exterior perimeter surface portion of the column and the blocking structure;

forming a second opening in at least one of the column and the blocking structure, the second opening being located proximate the second intersection of the exterior perimeter surface portion of the column and the blocking structure;

applying an inner fibrous sheet to the exterior perimeter surface portion of the column;

inserting a portion of a first fiber anchor through the first opening, the first fiber anchor comprising at least a first end;

securing the first end of the first fiber anchor to the inner fibrous sheet; and applying an outer fibrous sheet over the inner fibrous sheet, wherein the first end of the first fiber anchor is sandwiched between the inner fibrous sheet and the outer fibrous sheet.

12. The method of claim 11 further comprising inserting a second fiber anchor in the second opening, the second fiber anchor comprising a first end; and securing the first end of the second fiber anchor to the inner fibrous sheet;

wherein the first end of the second fiber anchor is sandwiched between the inner fibrous sheet and the outer fibrous sheet.

13. The method of claim 11 wherein the inner fibrous sheet is coextensive with the outer fibrous sheet.

14. The method of claim 11 wherein the inner fibrous sheet and the outer fibrous sheet are applied to extend across the exterior perimeter surface portion from adjacent the first intersection to adjacent the second intersection.

15. The method of claim 11 wherein securing the first end of the first fiber anchor to the inner fibrous sheet comprises splaying fibers in the first fiber anchor generally at the first end and connecting them to the inner fibrous sheet.

16. The method of claim 11 wherein forming the first and second openings comprises drilling first and second holes in converging directions.

17. The method of claim 11 wherein forming the first opening and forming the second opening comprises drilling through one of the column and the blocking structure from proximate the first intersection of the exterior perimeter surface portion of the column and the blocking structure through to the second intersection of the exterior perimeter surface portion of the column and the blocking structure.

18. The method of claim 11 further comprising a single passageway through at least one of the column and blocking structure connecting the first opening and the second opening.

19. The method of claim 18 wherein the first fiber anchor comprises a second end, the second end is secured to the inner fibrous sheet, and the second end is sandwiched between the inner fibrous sheet and the outer fibrous sheet.

20. The method of claim 18 wherein the first fiber anchor comprises a second end, and the method further comprises:

pushing the second end of the first fiber anchor through the first opening and then pulling the second end through the second opening; and securing the second end to the inner fibrous sheet.

21. The method of claim 11 further comprising forming at least a third opening in the exterior perimeter surface portion of the column and installing a third anchor in the third opening.

22. The method of claim 21 further comprising connecting splayed fibers of a first end of the third anchor to the inner fibrous sheet, and sandwiching the first end of the third anchor between the inner fibrous sheet and the outer fibrous sheet.

* * * * *